US006105793A

United States Patent [19]

Riga

[11] Patent Number: 6,105,793

[45] Date of Patent: Aug. 22, 2000

[54] DEATH CARE MERCHANDISE DISPLAY UNIT

[75] Inventor: Dennis J. Riga, New Albany, Ohio

[73] Assignee: The York Group, Inc., Houston, Tex.

[21] Appl. No.: 09/177,160

[22] Filed: Oct. 22, 1998

Related U.S. Application Data

[63] Continuation-in-part of application No. 08/788,324, Jan. 24, 1997, Pat. No. 5,901,862.

[51] Int. Cl.[7] ..... A47F 7/00

[52] U.S. Cl. ..... 211/85.16

[58] Field of Search ..... 211/85.16, 119.002, 211/27, 162; 52/36.1, 128, 134, 129; 27/1, 27

[56] References Cited

U.S. PATENT DOCUMENTS

| | | | |
|---|---|---|---|
| D. 48,928 | 4/1916 | Clark . | |
| D. 218,890 | 10/1970 | Kreminski | D19/1 |
| D. 350,246 | 9/1994 | Louise et al. | D6/479 |
| D. 351,076 | 10/1994 | Eliadis et al. | D6/476 |
| D. 354,825 | 1/1995 | Parker | D99/8 |
| D. 381,693 | 7/1997 | Thompson | D20/10 |
| 1,134,719 | 4/1915 | Benzing . | |
| 1,821,760 | 9/1931 | Leitch et al. . | |
| 3,190,243 | 6/1965 | Pira | 108/152 |
| 3,504,409 | 4/1970 | Keller, Jr. | 27/6 |
| 3,585,944 | 6/1971 | Schoer | 108/111 |
| 3,676,905 | 7/1972 | Mack | 27/6 |
| 4,891,897 | 1/1990 | Gieske et al. | 40/618 |
| 4,998,388 | 3/1991 | Englehart | 52/36 |
| 5,370,249 | 12/1994 | Harvey et al. | 211/189 |
| 5,405,017 | 4/1995 | Szabo, Sr., et al. | 211/13 |
| 5,495,954 | 3/1996 | Schmit | 211/90 |
| 5,524,394 | 6/1996 | Szabo, Sr., et al. | 52/36.1 |
| 5,622,010 | 4/1997 | Weber | 52/36.4 |
| 5,797,499 | 8/1998 | Pinco | 211/13.1 |
| 5,848,498 | 12/1998 | Szabo, Sr. et al. | 52/36.1 |

OTHER PUBLICATIONS

Gondola display stands at the top left and center of Uniweb Catalog, p. 27, 1985–86.

Casket, New York and Brooklyn Casket Co., p. 46, Per Manueal Oct. 1924.

*Primary Examiner*—Alvin Chin-Shue
*Assistant Examiner*—Sarah Purol
*Attorney, Agent, or Firm*—Stevens, Davis, Miller & Mosher, L.L.P.

[57] ABSTRACT

A death care merchandise display unit comprises two vertical, parallel, spaced wing wall panels, a vertical back wall means having lateral edges secured to the rear edges of the wing wall panels and at least one sectional decedent confinement chamber positioned between the two vertical spaced wing wall panels with at least one fabric board and a drawer and/or optional placard for displaying photographs, illustrations, or information. In addition, the cornice display structure may contain an illumination means affixed onto its inner perimeter. The securement means may further comprise a means for vertically stacking at least one additional sectional decedent confinement chamber from a vertical wing wall panel or the back wall or securing another modular display beside the first horizontal display unit.

16 Claims, 8 Drawing Sheets

DEATH CARE MERCHANDISE DISPLAY UNIT

This is a continuation-in-part application of U.S. patent application Ser. No. 08/788,324, filed Jan. 24, 1997, now U.S. Pat. No. 5,901,862.

SPECIFICATION

1. Field of the Invention

The present invention relates to an integrated display system for death care merchandise such as caskets, coffins, urns, burial vaults and materials for decorating or adorning the same. The display systems of the invention are particularly designed for use by prospective purchasers in a preview room. In addition, they may be useful for displaying death care merchandise during its intended use, such as in a memorial or funeral service as well as in a viewing room.

2. Background of the Invention

Various casket display systems are known in the art. The more primitive of such systems consist of a casket display rack or support. See, for instance, U.S. Pat. No. 2,937,768 which discloses a two-tiered casket display rack having a rigid C-shaped frame-like structure for the display of two caskets—one casket supported above another.

U.S. Pat. No. 5,405,017 discloses a more contemporary casket display system for full caskets. The display system of the '017 patent includes a two-tiered casket display rack retractable by means of a scissors unit which, in turn, is connected to a rod. The display rack of the '017 patent is not an integral part of the casket display system.

While the casket display system of the '017 patent offers a more serene setting than the primitive systems of the prior art, as set forth in the '768 patent, they do not permit the full display of merchandise used in the funeral and death care industry. In addition, it does not permit the display of all types of merchandise such as adornment accessories, urns, and burial vaults.

Further, the display systems of the prior art containing a rollout rack onto which a full casket is mounted basically require the presence of two caskets—one on a top shelf and the second on a bottom shelf. Such systems are difficult to manage and handle especially since the lower casket is often required to be in a retracted state.

The need exists therefore for a display system which permits the exhibition of a greater volume and a greater type of death related merchandise at greater ease for the prospective purchaser. In addition, the need exists for a display system which can be more easily assembled and utilized than afforded by the systems of the prior art.

SUMMARY OF THE INVENTION

A death care merchandise display unit which maximizes the types and styles of death care merchandise comprises two vertical, parallel, spaced wing wall panels, and a vertical back wall having lateral edges secured to the rear edges of the wing wall panels. The display unit may contain one or more fabric boards and may further contain a cornice. Additionally, the display unit may contain doors on the front to protect it and to facilitate shipping.

Further, the display unit of the invention may contain one or more retractable drawers in relatively close proximity to the rack(s) displaying the burial vault, coffin or casket.

Another embodiment of the invention is directed to a stackable death care merchandise display unit having means for interconnecting two or more stackable units.

Yet another embodiment of the invention is directed to a modular death care merchandise display unit having a means for interconnecting two or more modular units.

DETAILED DESCRIPTION OF PREFERRED EMBODIMENTS

The present invention provides an integrated display system for death care related merchandise. The display system of the invention is principally used in a preview room where selection of death care related merchandise by the decedent's loved ones occurs. In addition, the display system of the invention may be used in death related ceremonial areas such as the viewing room of a funeral home as well as at funeral and memorial services.

The display system of the invention is defined by a back wall and side or wing walls. One of the principal advantages of the display system of the present invention is that it maximizes the number and types of death care merchandise which may be displayed in a given area.

The display system of the invention may further be a stackable and/or modular assembly; permitting it to be assembled and disassembled within a short period of time as well as on an "as needed" basis. The ability of the display system to be stackable and/or modular permits purchasers to buy all or sections of the system when so desired.

Figure 1:
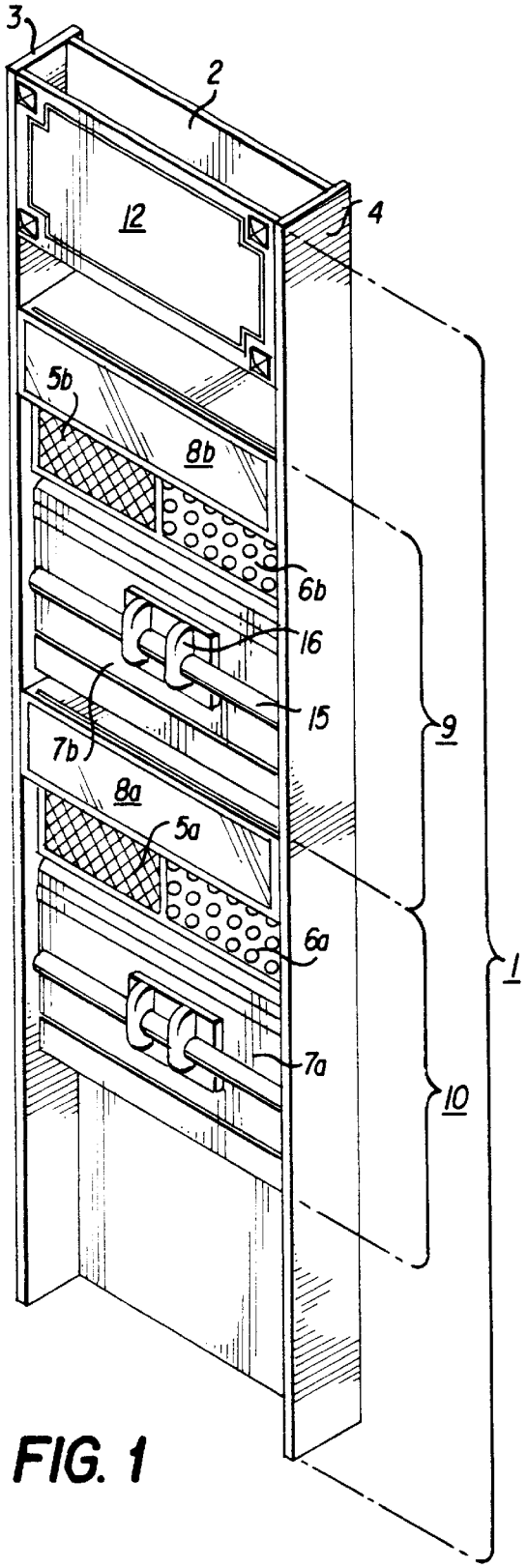
FIG. 1 is a frontal view of one embodiment of the display unit of the invention.
Figure 2:
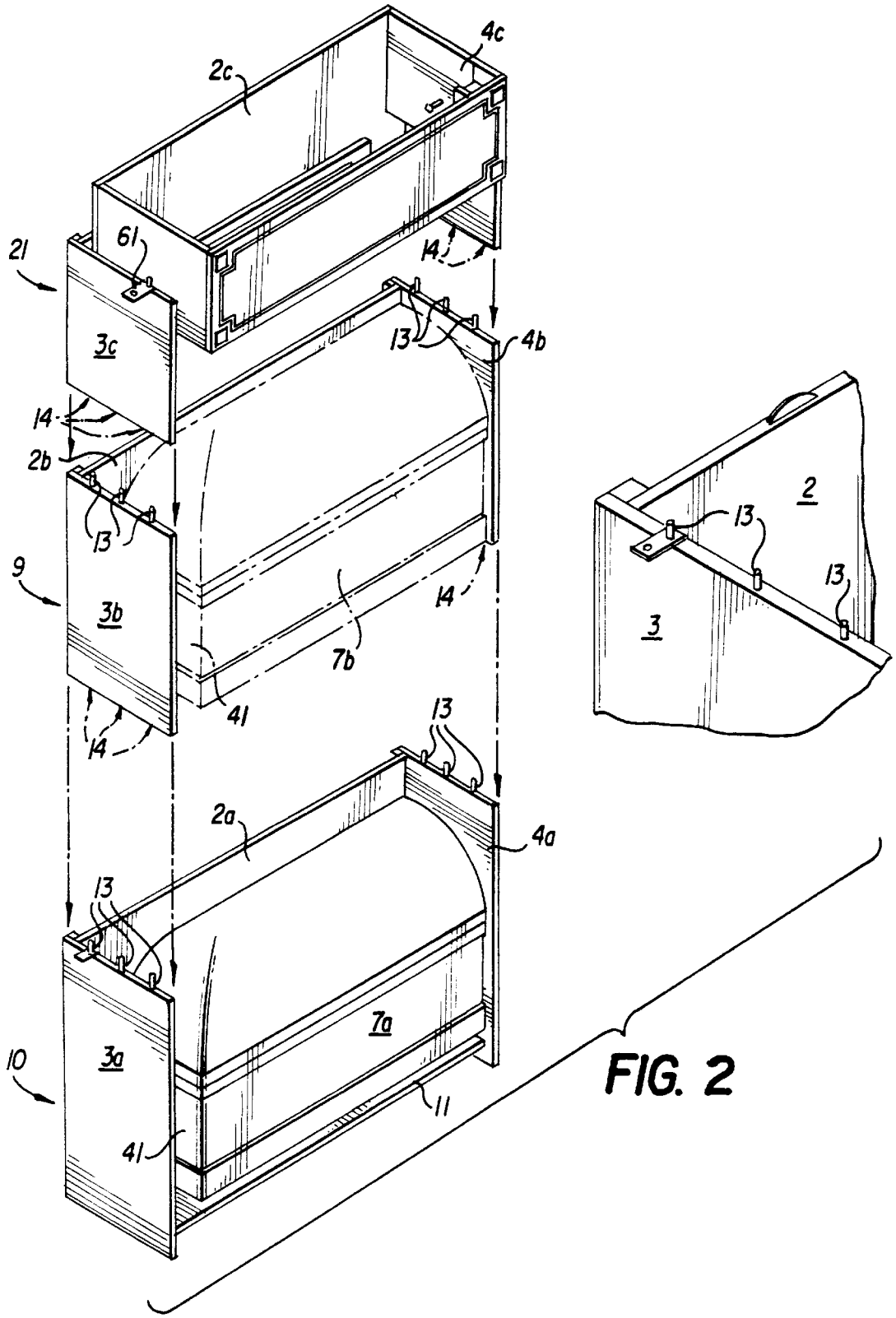
FIG. 2 is an exploded view of the stackable display unit of the invention.

The display system contains a number of novel features which may be used alone or in combination with each other. FIGS. 1 and 2 show an embodiment of the death care merchandise display system 1 of the invention, principally for use in preview rooms. The display system 1 comprises a back wall 2 and two side or wing wall panels 3 and 4. Wing wall panels 3 and 4 are connected with back wall 2 at the rear section of each wing wall panel 3 and 4. The vertical back wall 2 may be removably secured to the rear edges of wing wall panels 3 and 4.

Figure 3:
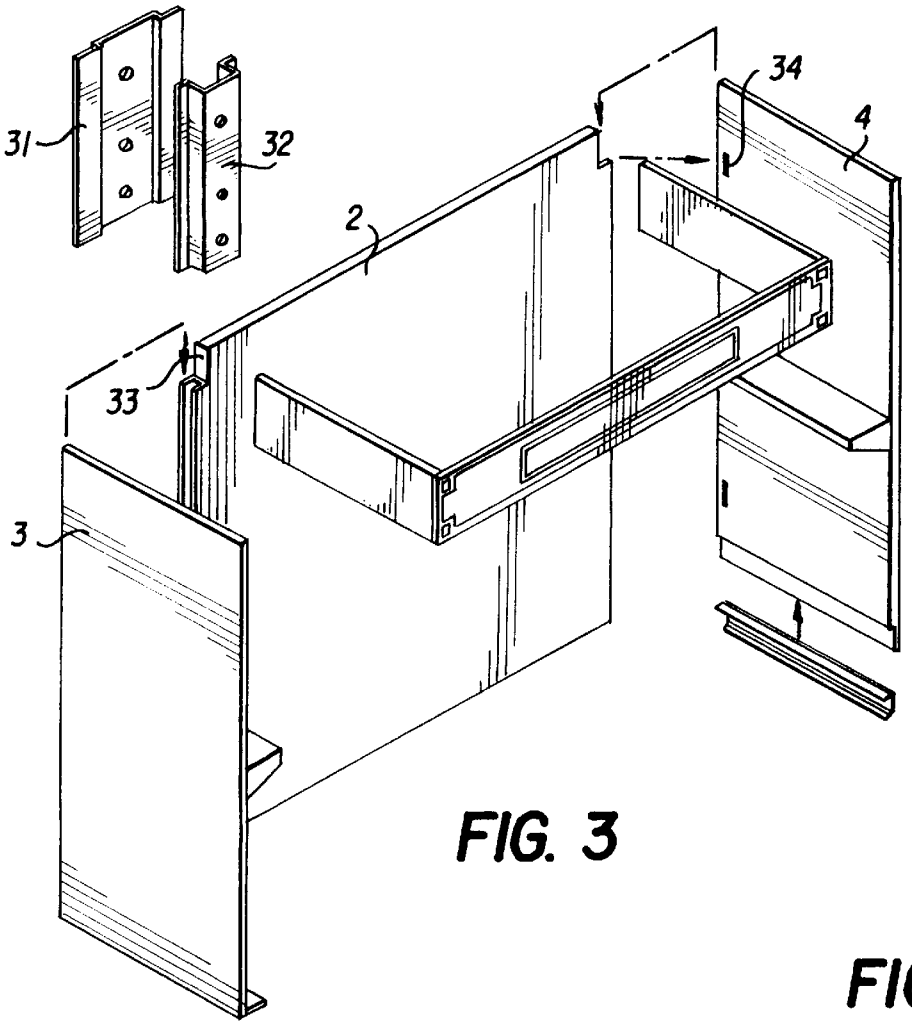
FIG. 3 is an exploded view of one embodiment of the display unit of the invention showing the cornice assembly.
Figure 5:
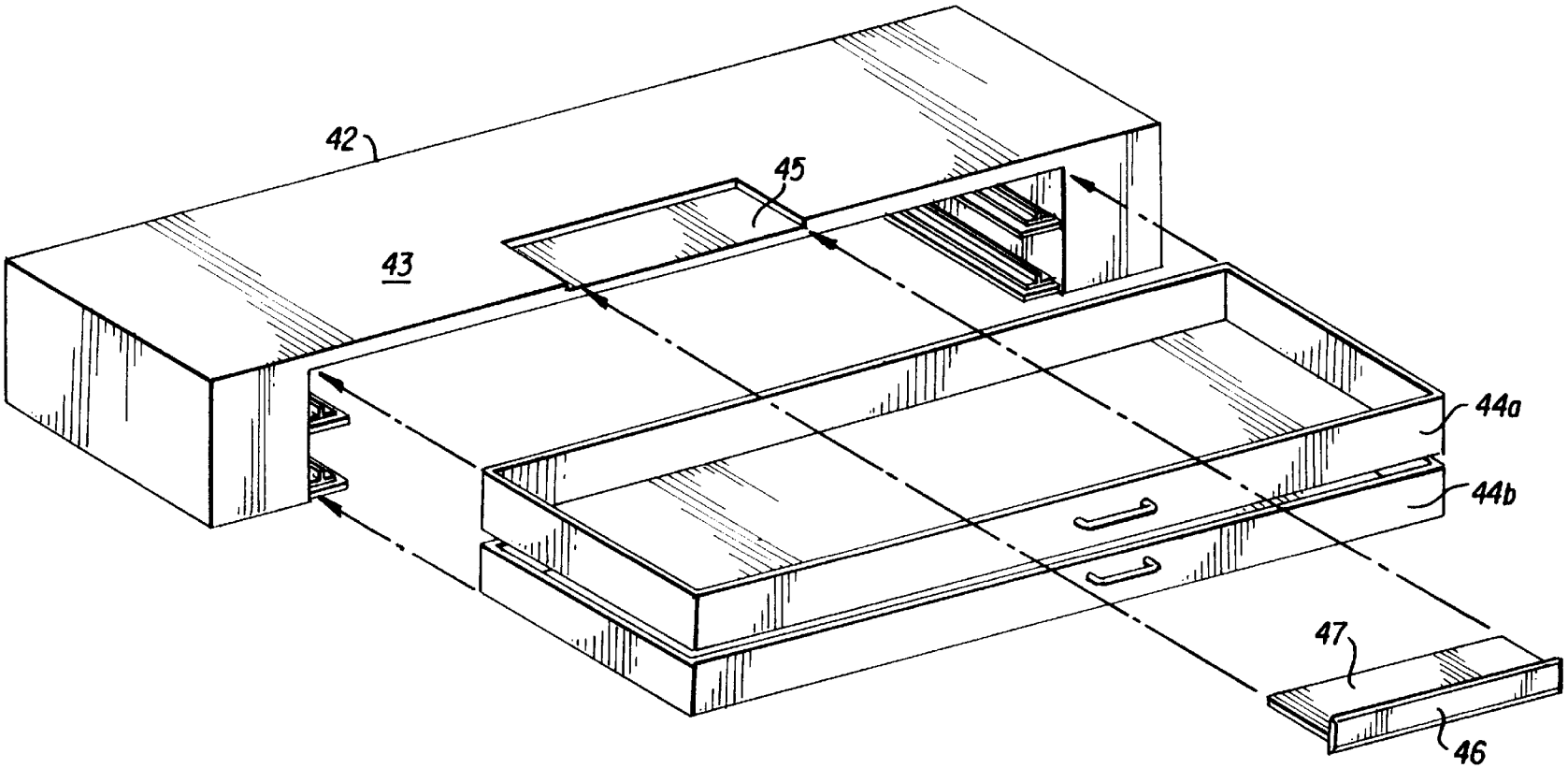
FIG. 5 is an exploded view of the drawer assembly unit for use with the invention.

As set forth in FIG. 3, wing wall panels 3 and 4 are attached to back wall panel 2 by conventional ready-to-assemble ("RTA") fittings in the art. Depicted are fitting 31 with flanges which mate with fitting 32 having an approximate ½" deep recessed area. Back wall panel 2 has an L-shaped cut 33 and wing wall panels 3 and 4 have receptor notch 34 for the RTA fittings.

The back and wing wall panels of the display system of the invention are typically plywood but may be fiberwood or other durable material such as a synthetic plastic material as plexiglass or Mylar. The back wall or wing wall panels may be covered with a fabric-like material or have a textured surface. When so desired, the fabric-like material may be removably attached to the panel allowing the user to select the color and texture.

Back wall panel 2 and wing wall panels 3 and 4 may include known means for removably attaching objects such as signs and photographs. The means for attaching objects include, e.g., peg-board type attachments, slat wall, stackable surfaces, hook-and-loop fabric (e.g., VELCRO®) attachments, magnetic attachments or other known devices for removably attaching objects to a vertical surface for display of the objects.

The alcove defined by back wall 2, left wing wall panel 3 and right wing wall panel 4 may display one or more sectional decedent confinement chambers 7*a*, 7*b*, and/or 7*c*. The decedent confinement chambers may be sectionals of actual size or miniatures.

FIG. 1 illustrates an alcove having two sectionals of actual size decedent confinement chambers. The sectionals preferably contain that portion of the decedent confinement chamber showing the handle 15 and guiding rod 16. The display unit may contain a first bottommost or base modular unit 10 and a second modular unit 9. Both the second modular unit 9 and the base modular unit 10 are secured to wing wall panels 3 and Display unit 1 may further contain identification placards 8*a* and 8*b* on top of sectional decedent confinement chambers 7*a*, 7*b*, and/or 7*c*. In preview rooms, identification placards 8*a* and 8*b* may be used to inform the customer of features of the displayed casket. Such placards may consist of photographs of a sectional or whole decedent confinement chamber in an open or closed position. Communicative materials, such as signage, may further be mounted on back wall 2 or wing wall panels 3 or 4 to designate information about the death care related merchandise (when used in a showroom display setting) or the decedent (when used in a viewing room, funeral home or memorial service setting). When used in a preview room display setting, each of the sectional decedent confinement chambers 7*a*, 7*b*, and/or 7*c* may be displayed with signage or other communicative means providing information to the prospective purchaser of the chamber. Identification placards 8 may include signage.

The wing and wall panels 3 and 4, illustrated in FIGS. 1 and 2 are typically 5 to 7feet, preferably 6 feet, tall. The length of back wall 2 is sufficient to contain a sectional of an actual size decedent confinement chamber.

As used herein, the term "decedent confinement chamber" shall refer to a casket, coffin or burial vault and, where appropriate, urns. The term shall include ready-for-use caskets, coffins, and burial vaults as well as the facade of caskets, coffins, and burial vaults. Where the display unit is to be used in a preview room and designed not to be opened, it is especially preferred to use facades of such caskets, coffins, and burial vaults. The facade typically includes those outer sides and surfaces of the chamber visible to the observer. Where the chamber is being used to exhibit only the facade, the inner chamber is hollow.

It is often desirable to secure the unit to a stationary support. Thus, the back wall 2 may be secured to the adjoining wall (or sheetrock) surface of the building. Alternatively, or in addition to securing the back wall to the adjoining wall, the base of the wing wall or back wall may be bolted, by means of conventional fasteners, to the floor.

The display unit of the invention may contain one or more shelves. FIG. 2 illustrates shelving 11 for the mounting of a non-retractable decedent confinement chamber. Additional support for the chamber may be provided by extending shelving 11 the length of the interior of the alcove defined by back wall 2 and wing wall panels 3 and 4.

In order to increase the number and types of decedent confinement chambers being displayed, the display unit of the invention preferably contains sectional decedent containment chambers. A sectional decedent containment chamber is a partial casket, coffin or burial vault cut in such a manner so as to be mounted on the receiving wall. FIG. 2 illustrates an alcove containing two sectional decedent confinement chambers 7*a* and 7*b*. As set forth in FIG. 4, a sectional decedent containment chamber 7*a*, cut at 90°, allows the observer to view the left end 41 of the chamber along with all external ornamentation of the segmented chamber that usually includes handle 15 and guiding rod 16. The partial chamber may be a facade only or contain an interior view of the segmented chamber being presented.

Figure 8:
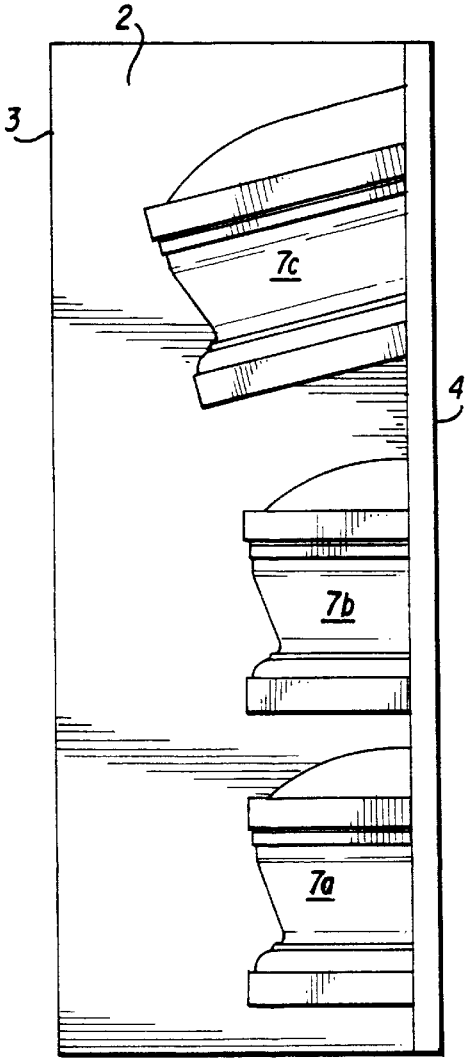
FIG. 8 is a frontal view of the display having three sectional decedent confinement chambers.

As set forth in FIG. 8, the decedent containment chamber for use in the invention may further be sectioned at an angle greater than 90° from the wall panel. When secured on a flat wall, the sectional decedent containment chamber 7*a*, allows the observer to more keenly view a chamber appearing higher with the alcove. In addition, the interior of an opened chamber is more easily viewable when the chamber is sectioned at an angle greater than 90°. When so sectioned, the partial chamber appears to the observer in a position which is slanted in a downward direction. Sectional decedent confinement chambers 7*a*, 7*b*, and/or 7*c* may be easily mounted onto wing wall panels 3 or 4 and/or back wall.

As illustrated in FIG. 2, the death care merchandise display system of the invention may be comprised of stackable modular units. As such, a given modular system may be modified to include any number of modular units. For instance, the modular system may contain two stackable units containing sectional decedent confinement chambers 41 as depicted in FIG. 2. The top surfaces of wing wall panels 3*a* and 4*a* and back wall 2*a* of lower modular unit 10 may include dowels 13. The bottom surface of wing wall panels 3*b* and 4*b* and back wall 2*b* of adjoining upper modular unit 9 contain holes 14 for mating with dowels 13. The top surfaces of wing wall panels 3*b* and 4*b* and back wall 2*b* of upper modular unit 9 also include dowels for interlocking with the holes on the bottom surface of the wing wall panels 3*c* and 4*c* and back wall panel 2*c* of the top cornice assembly.

Figure 4:
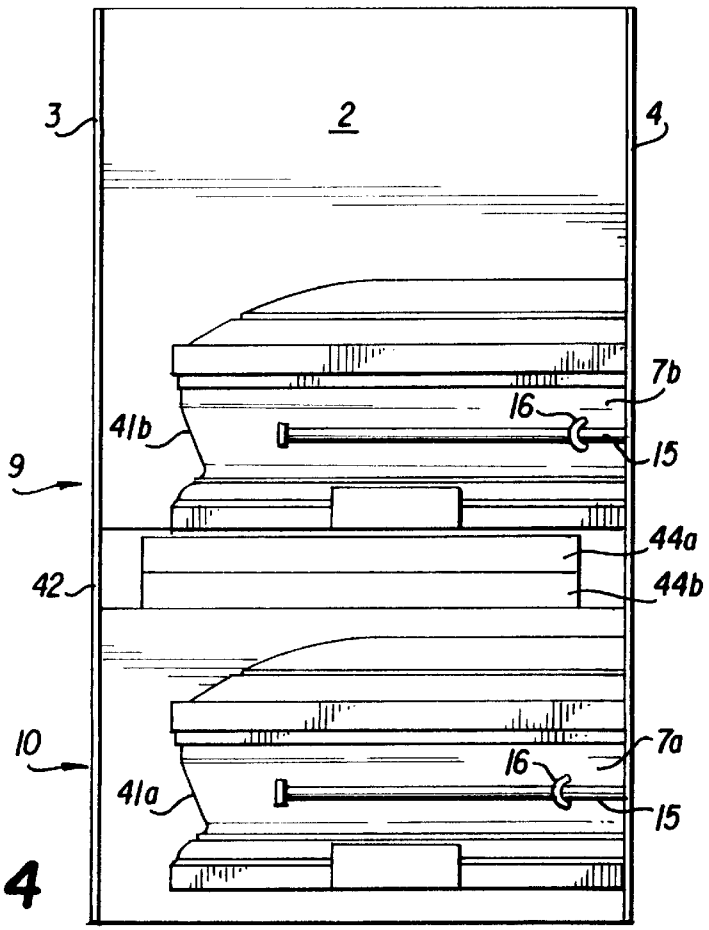
FIG. 4 is a frontal view of the display unit having two sectional decedent confinement chambers.

FIG. 4 presents another embodiment of the invention directed to a display unit containing a top and bottom sectional decedent confinement chambers 7*a* and 7*b*. The sectional decedent confinement chambers 7*a* and 7*b* illustrated in FIG. 4 may be "quarter caskets," each representing one quarter of a full size casket. As depicted, the unit is about six feet tall and four feet wide.

The merchandise display unit 1 of the invention may further contain one or more retractable drawers 44*a* and 44*b* and may contain at least one display board 5*a*, 5*b*, and 6*a*, and/or 6*b* for displaying accessories typically used with the decedent confinement chamber on display. Such accessories include fabrics for the cap panel—that portion of the interior of the chamber lining the upper part of the lid, as well as the overlay—the fabric which lies across the outside of the chamber when the lid of the chamber is opened. Display boards 5*a* and 5*b* and 6*a* and 6*b* may be secured to wing wall panels 3 and 4 and/or back wall 2. The drawer 44*a* or 44*b* could further be modified to hold the samples of ornamental trims for the exterior of the chamber being displayed.

The retractable drawer unit 42 of FIG. 4 consists of two sets of retractable drawers 44*a* and 44*b*. In operation, each of the drawers may display adornment materials for separate decedent confinement chambers. The drawers are retractable by conventional bottom mounted drawer slides conventional in the art. The top surface 43 of the drawer unit 42 may contain recessed area 45 for placement of sign placard 46. Base 47 of placard 46 fits within recessed area 45. The front surface of the placard may contain additional information about the chamber on display (where used in a preview room) or the decedent (where used in a funeral home or memorial service setting). Retractable drawer unit 42 may extend from wing wall panel 3 to wing wall panel 4.

The merchandise display system of the invention may further contain a cornice 12. Any conventional cornice or soffit disclosed in the art may suffice. For instance, the cornice may consist of a horizontal beam which extends from wing wall panel 3 to wing wall panel 4. Typically, the use of a cornice will increase the display height to above 7 feet. In a preferred embodiment, the height of the wing wall panels and back wall panels, when cornice is added, is about 7.5 feet.

A particularly preferred cornice is that set forth in FIG. 3 which is easy to produce and which affords to the display a more than adequate amount of light. The cornice 12 is mounted along the upper portion of either back wall 2 or wing wall panel 3 and 4 of the display unit. An illumination source 35 can be attached by any means to the backside of the cornice 12 to provide additional illumination.

The placard 8 may contain information about either the decedent (where the unit is employed in memorial settings or funerals) or the merchandise displayed (where the unit is employed for point-of-sale merchandise). For instance, in point-of-sale merchandise, placard 8 can display photographs, illustrations, or information about the materials used in the manufacture of the decedent confinement chamber, such as "Stainless Steel," "Veneer," "Hardwood," "Steel," etc. as well as information about the merchandise on display, such as "Interiors" for a display illustrating the interior of the decedent confinement chamber.

The cornice 12 may be secured to either the back wall 2 of wing wall panels 3 and 4 of the display unit by various known means, e.g., by a RTA fitting, by a threaded screw connection, by gravity lock method, or otherwise as known to those in the art. The preferred connecting member is the ready-to-assemble ("RTA") fitting 61, which includes a threaded fastener such as a machine-threaded screw extending longitudinally outward from the end of the receiving member and attached to a threaded nut or other threaded retaining device. For instance, the screw head of the RTA fitting may extend from the back wall of the connecting member. Receiving member is attached to the receiving end.

Figure 6:
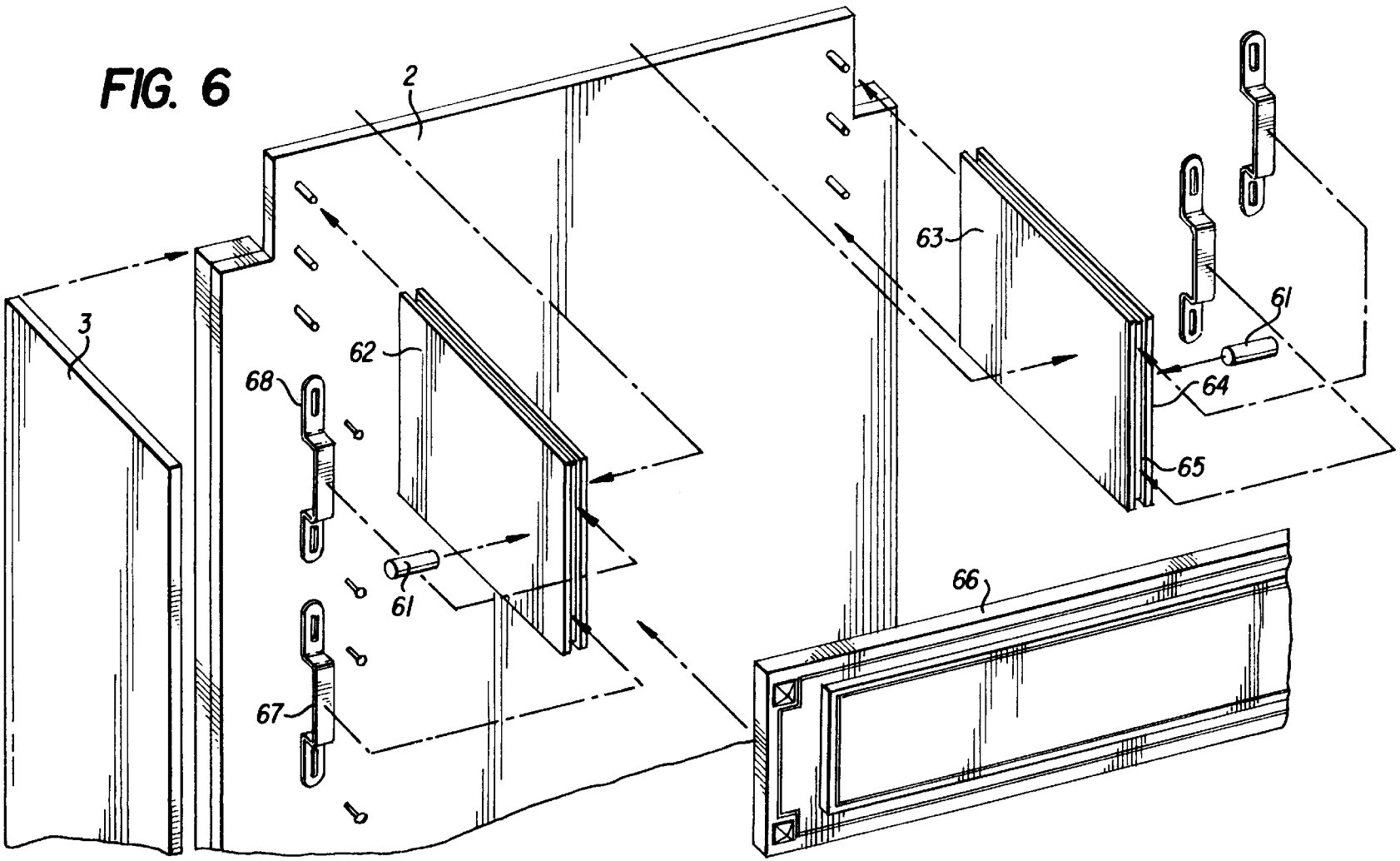
FIG. 6 is an exploded view of the cornice assembly secured to the back wall.

FIG. 6 demonstrates one method of securing the cornice assembly to back wall 2. Vertical beams 62 and 63 are secured to back wall 2 by threaded screws extending from the back of back wall 2 into the vertical beam. Mounting brackets are secured to the top 64 and bottom 65 of the front vertical beams 62 and 63. Mating screws are inserted into the back of horizontal beam 66 which interlock within the groove 67 of mounting bracket 68.

The configurations for use in the invention may further be characterized as a stackable display system wherein stackable units are prefabricated and are removably attached to one another to create the desired alcove configurations. In this manner, pieces of the display unit may be mixed or matched as well as be purchased concurrently with each other or at different times. FIG. 2 exemplifies the stackable display unit. The base unit 10 of the stackable system contains back wall 2*a* secured to wing wall panels 3*a* and 4*a*. The top surfaces of wing wall panels 3*a* and 4*a* as well as the top surface of back wall 2*a* have dowels 13. The holes 14 in the bottom of second stackable unit 9 are recessed and interlock with dowels 13 of base unit 10. Alternatively, the top of base unit 10 may interlock with the bottom of second stackable unit 9 by other conventional means. Second stackable unit 9, in turn, contains dowels 13*b* on the top surface of left wing wall 3*b*, right wing wall 4*b*, and back wall 2*b* panel for engaging the recessed groove running the bottom perimeter of third modular unit 21.

Base stackable unit 10 may contain shelving 11, such as that illustrated in FIG. 2 for a stationary sectional decedent confinement chamber or may contain the requisite hardware for receiving a butt end sectional decedent confinement chamber 4. The third stackable unit 21 may contain a cornice 12 (illustrated in FIG. 3) with or without illumination means.

Figure 7:
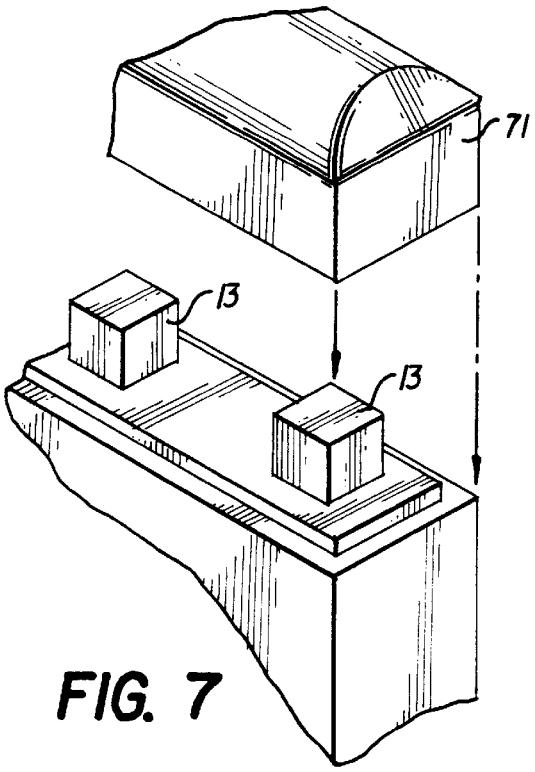
FIG. 7 illustrates a decorative endcap for the modular display unit of the invention.

Decorative endcap 71, as shown FIG. 7 further may be affixed to the top of dowels 13 of either base unit 10, second stackable unit 9, or third stackable unit 21. Endcap 71 has a recessed groove which interlocks with the dowels 13 of the uppermost unit of the display. The endcap can easily be unsnapped off of the lip to add additional modules when so desired.

Figure 9:
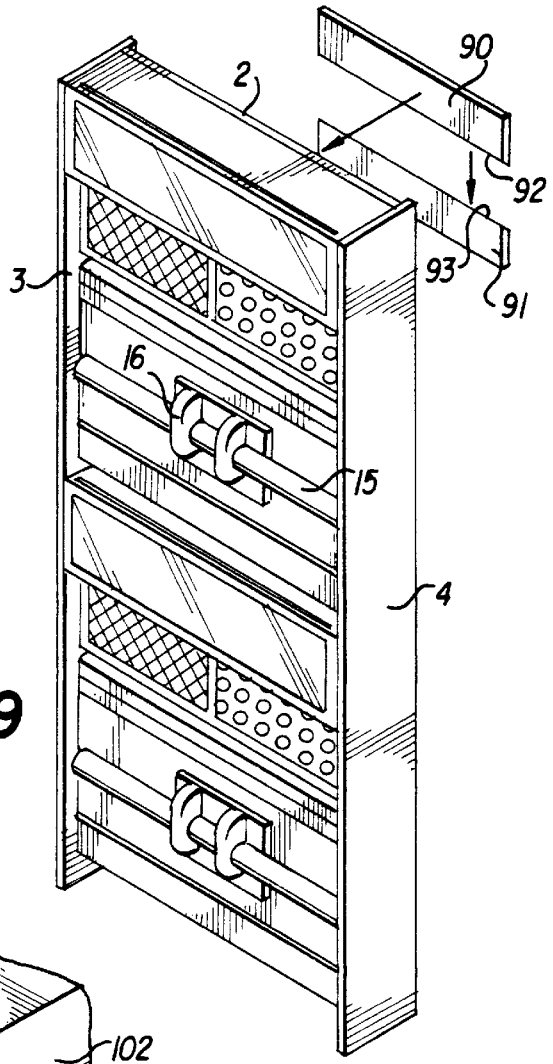
FIG. 9 is an exploded view of one method to attach the display unit to the wall.

It is often desirable to secure display unit 1 to a stationary support. Thus, back wall 2 may be secured to the adjoining wall (or sheetrock) surface of the building. FIG. 9 illustrates a possible securing solution where a bracket 90 is attached by any means to the back surface of back wall 2. Bracket 90 creates a mating groove 92 that can interlock with a mating groove 93 of bracket 91 to create a French cleat. Though certainly not the only method of attaching display unit 1 to a wall, this method offers a removably secure method to prevent toppling.

Figure 11:
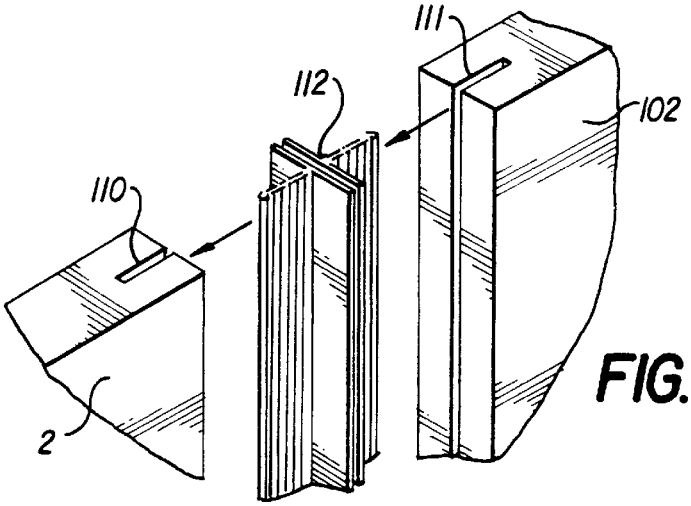
FIG. 11 shows how the modular display units may be connected.
Figure 10:
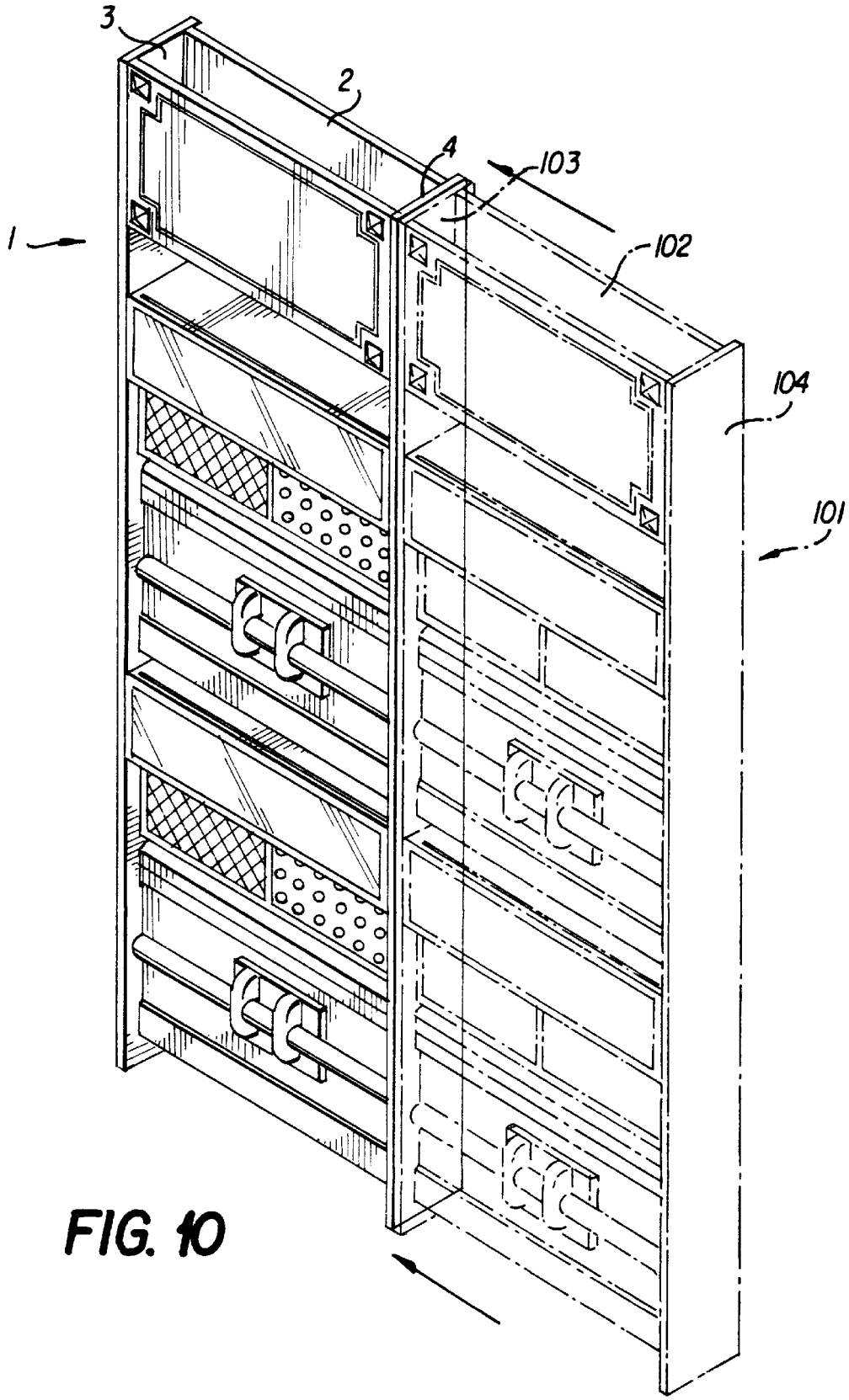
FIG. 10 illustrates two modular display units affixed side by side.

The configurations for use may further be characterized by a modular display system wherein modular display units are prefabricated and are removably attached to one another to create the desired alcove configurations. In this manner, pieces of the display unit may be mixed or matched as well as be purchased concurrently with each other or at different times. FIG. 10 exemplifies the modular display unit. Display unit 1 contains back wall 2 and wing wall panels 3 and 4, any of which may contain a longitudinal groove 110 on back wall 2 illustrated in FIG. 11. A second modular display unit 101 can be attached to display unit 1 at a back wall 102, wing wall panel 103, and/or wing wall panel 104 via another longitudinal groove 111 depicted, for example, on back wall 102 in FIG. 11. In FIG. 11, an elongated mounting bracket 112 can be pushed into elongated groove 110. Then second modular unit 101 can be aligned and pushed into place such that mounting bracket 112 is forced into longitudinal groove 111.

Figure 12:
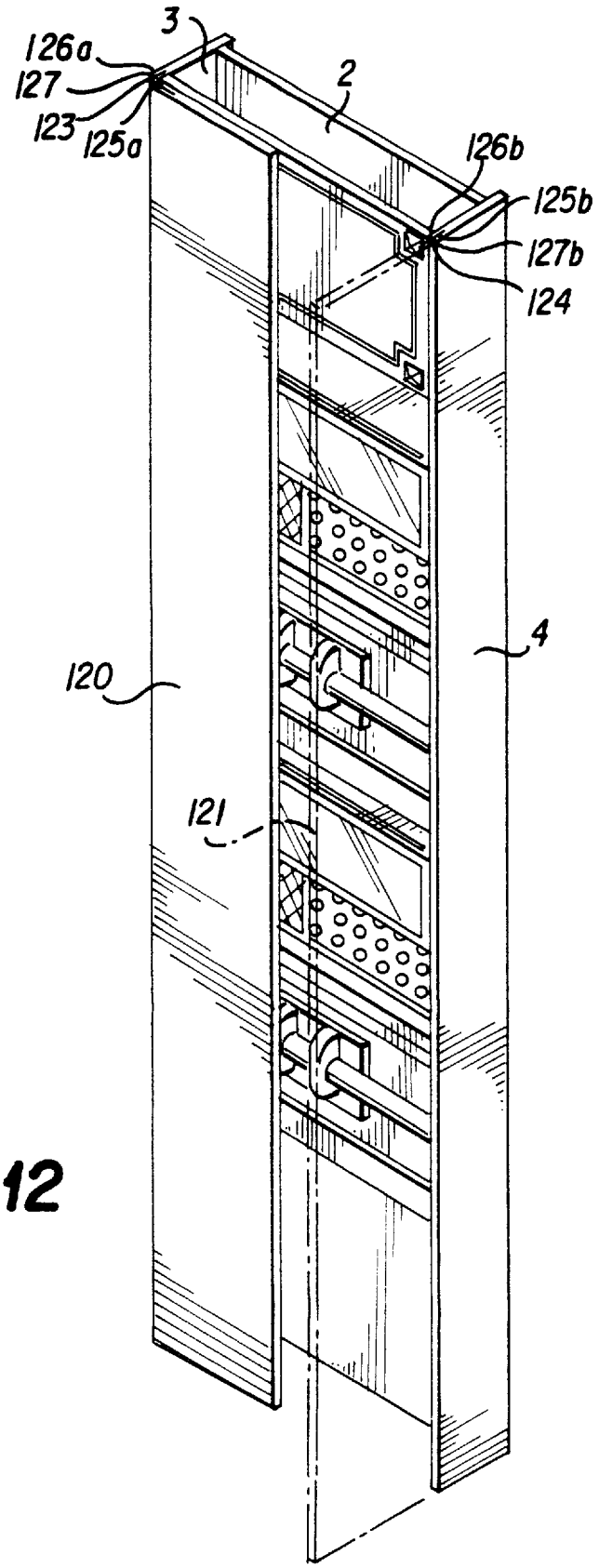
FIG. 12 shows the doors that may be used to protect the display unit during transit.

FIG. 12 illustrates doors 120 and 121 that are longitudinally attached to front edges 123 and 124 of wing wall panels 3 and 4, respectively. One means of attachment that may be used is similar to the method depicted in FIG. 11 whereby longitudinal grooves 125 and 126 can accommodate an elongated, hinged bracket 127 which allows doors 120 and 121 to be opened and shut. An analogous procedure to the connection of display unit 1 to second modular unit 101 depicted in FIG. 11 may be utilized to attach the doors 120 and 121 to display unit 1.

A finish on any or all of the surfaces of the merchandise display unit may be placed to more closely coordinate with the merchandise being displayed. For instance, where the merchandise display is of caskets or coffins, the back and side walls of the display unit may be pigmented to enhance the colors of the merchandise.

Various modifications may be made in the nature, composition, operation, and arrangement of the various elements, steps, and procedures described herein without departing from the spirit and scope of the invention as defined in the following claims.

What is claimed is:

1. The death care merchandise display unit comprising:

two vertical, parallel, spaced wing wall panels and a back wall having lateral edges secured to the rear edges of the wing wall panels, the back wall supporting said wing wall panels and maintaining them in a vertical attitude;

at least one sectional decedent confinement chamber secured to at least one of the back wall or wing wall panels of the death care merchandise display unit, wherein the sectional decedent confinement chamber is selected from sectionals of caskets, coffins, burial vaults or miniatures thereof;

at least one fabric board secured to the front edge of at least one of the wing wall panels and/or back wall; and at least one door.

2. The death care merchandise display unit of claim 1, further comprising a cornice.

3. The death care merchandise display unit of claim 1, further comprising at least one placard secured to the front edge of at least one of the wing wall panels and/or the back wall.

4. The death care merchandise display unit of claim 1, further comprising one drawer assembly attached to the back wall and/or the wing wall panels.

5. A stackable death care merchandise display unit having as a first display unit:

two vertical, parallel, spaced wing wall panels;

a vertical back wall having lateral edges secured to the rear edges of said wing wall panels;

least one sectional decedent confinement chamber or a miniature of a decedent confinement chamber secured to at least one of the back wall or wing wall panels of the stackable death care merchandise display unit;

said wing wall panels further having a means for securing, when desired, vertical, parallel, spaced wing wall panels of a second stackable display unit on top of the wing wall panels of the first display unit; and said back wall panel further having a means for securing, when desired, a vertical back wall on top of the second stackable display unit.

6. The stackable death care merchandise display unit of claim 5, further comprising a cornice.

7. The stackable death care merchandise display unit comprising as a first display unit:

two vertical, parallel, spaced wing wall panels;

a vertical back wall having lateral edges secured to the rear edges of said wing wall panels;

at least one sectional decedent confinement chamber or a miniature of a decedent confinement chamber secured to at least one of the back wall or wing wall panels of the stackable death care merchandise display unit;

said wing wall panels further having a means for securing, when desired, vertical, parallel, spaced wing wall panels of a second stackable display unit on top of the wing wall panels of the first display unit;

said back wall panel further having a means for securing, when desired, a vertical back wall on top of the second stackable display unit; and at least one door.

8. The stackable death care merchandise display unit of claim 5, further comprising one drawer assembly attached to the back wall and/or the wing wall panels.

9. The stackable death care merchandise display unit of claim 5, further comprising at least one fabric board secured to at least one of the wing wall panels and/or back wall.

10. A modular death care merchandise display unit comprising as a first display unit:

two vertical, parallel, spaced wing wall panels;

a vertical back wall having lateral edges secured to the rear edges of said wing wall panels;

at least one decedent confinement chamber secured to at least one of the back wall or wing wall panels of the modular death care merchandise display unit, wherein the decedent confinement chamber is selected from facades or sectionals of caskets, coffins, burial vaults, or miniatures thereof; and said wing wall panels and/or back wall further having a means for securing beside, when desired, a second modular display unit to the wing wall panels and/or back wall of the first display unit.

11. The modular death care merchandise display unit of claim 10, further comprising a cornice.

12. The modular death care merchandise display unit comprising as a first display unit:

two vertical, parallel, spaced wing wall panels;

a vertical back wall having lateral edges secured to the rear edges of said wing wall panels;

at least one sectional decedent confinement chamber secured to at least one of the back wall or wing wall panels of the modular death care merchandise display unit, wherein the sectional decedent confinement chamber is selected from sectionals of caskets, coffins, burial vaults, or miniatures thereof;

at least one fabric board secured to the front edge of at least one wing wall panel and/or back wall;

said wing wall panels and/or back wall further having a means for securing beside, when desired, a second modular display unit to the wing wall panels and/or back wall of the first display unit; and at least one door.

13. The modular death care merchandise display unit of claim 10, further comprising one drawer assembly attached to the back wall and/or wing wall panels.

14. The modular death care merchandise display unit of claim 10, further comprising a second display unit beside the first display unit, said second display unit defined by two vertical, parallel, spaced wing wall panels having vertical rear and front edges and a vertical back wall panel having lateral edges secured to said rear edges of the wing wall panels of the second display unit.

15. The modular death care merchandise display unit of claim 11, further comprising a cornice.

16. The modular death care merchandise display unit of claim 14, wherein said means for securing comprises a mounting bracket which is sized and shaped to fit within a groove formed in said back wall panels.

* * * * *